US011506420B2

(12) United States Patent
Porwal et al.

(10) Patent No.: US 11,506,420 B2
(45) Date of Patent: Nov. 22, 2022

(54) RETROFIT HEAT PUMP WATER HEATING SYSTEMS

(71) Applicant: Rheem Manufacturing Company, Atlanta, GA (US)

(72) Inventors: Piyush Porwal, Montgomery, AL (US); Mukund Bhaskar, Montgomery, AL (US); Jessie Dixon, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 171 days.

(21) Appl. No.: 16/902,569

(22) Filed: Jun. 16, 2020

(65) Prior Publication Data

US 2021/0389024 A1 Dec. 16, 2021

(51) Int. Cl.

| | |
|---|---|
| ***F24H 4/02*** | (2022.01) |
| ***F25B 6/02*** | (2006.01) |
| ***F25B 5/02*** | (2006.01) |
| ***F25B 30/02*** | (2006.01) |

(52) U.S. Cl.

CPC ..... *F24H 4/02* (2013.01); *F25B 5/02* (2013.01); *F25B 6/02* (2013.01); *F25B 30/02* (2013.01)

(58) Field of Classification Search

CPC ..... F24H 4/00; F24H 4/02; F24H 4/04; F24H 4/06; F25B 5/02; F25B 6/02; F25B 30/00; F25B 30/02

See application file for complete search history.

(56) References Cited

U.S. PATENT DOCUMENTS

| | | | | |
|---|---|---|---|---|
| 2,516,094 | A * | 7/1950 | Ruff | F25B 30/02 165/47 |
| 2,632,306 | A * | 3/1953 | Ruff | F24F 5/00 62/506 |
| 2,716,866 | A * | 9/1955 | Silva | F24H 4/04 122/26 |
| 4,320,630 | A * | 3/1982 | Uselton | F25B 30/02 62/238.6 |
| 5,226,285 | A * | 7/1993 | Dankowski | F24F 1/0083 165/95 |
| 9,109,811 | B2 * | 8/2015 | Duplessis | F24H 4/04 |
| 9,157,655 | B2 * | 10/2015 | Babb | F24D 17/0036 |
| 9,341,384 | B2 * | 5/2016 | Babb | F24H 9/2007 |
| 9,518,761 | B2 * | 12/2016 | Rissler | F25B 30/02 |
| 10,718,549 | B2 * | 7/2020 | Pugh | F24H 9/2007 |
| 10,914,491 | B2 * | 2/2021 | Boros | F25B 1/005 |
| 2007/0146995 | A1 * | 6/2007 | Zhao | H01L 23/4006 257/E23.084 |

(Continued)

*Primary Examiner* — Miguel A Diaz

(74) *Attorney, Agent, or Firm* — Eversheds Sutherland (US) LLP

(57) ABSTRACT

A retrofit heat pump system for a water heater is disclosed. The heat pump system includes a plurality of evaporators to increase the efficiency of heat exchange for the system. The system can also include a plurality of condenser circuits used to heat the water of an existing water tank. A fan disposed in a housing of the heat pump system can draw air across the plurality of evaporators and exhaust cool air external to the heat pump system. The cool air can be exhausted into duct work associated with an air conditioning system of the home. The disclosure also describes a refrigerant distributor for providing uniform liquid refrigerant to the plurality of evaporators.

20 Claims, 8 Drawing Sheets

(56) References Cited

U.S. PATENT DOCUMENTS

| | | | | |
|---|---|---|---|---|
| 2008/0174964 | A1* | 7/2008 | Zhou | H01L 23/427 361/702 |
| 2009/0321041 | A1* | 12/2009 | Hammond | F24D 15/04 165/104.34 |
| 2010/0043464 | A1* | 2/2010 | McNeil | F24H 4/04 62/238.7 |
| 2010/0073876 | A1* | 3/2010 | Liu | H01L 23/3672 361/696 |
| 2010/0209084 | A1* | 8/2010 | Nelson | F24H 4/04 62/238.7 |
| 2010/0235991 | A1* | 9/2010 | Ward | A47C 21/048 165/61 |
| 2011/0252820 | A1* | 10/2011 | Hockman | F25B 30/00 62/238.7 |
| 2012/0186139 | A1* | 7/2012 | O'Brien | F28D 1/024 43/132.1 |
| 2013/0042635 | A1* | 2/2013 | Nelson | F24H 9/2021 62/238.7 |
| 2014/0137813 | A1* | 5/2014 | Gross | F25B 27/02 62/238.7 |
| 2014/0157814 | A1* | 6/2014 | Duplessis | F24H 4/04 62/324.1 |
| 2017/0284702 | A1* | 10/2017 | Boros | F24H 4/02 |
| 2018/0163991 | A1* | 6/2018 | Shaffer | F24H 9/16 |
| 2019/0003758 | A1* | 1/2019 | Scalf | F25D 23/04 |
| 2019/0099692 | A1* | 4/2019 | Vollmer, II | C02F 9/005 |
| 2019/0128565 | A1* | 5/2019 | Pugh | F24D 19/1054 |
| 2020/0386444 | A1* | 12/2020 | Pugh | F25B 49/02 |
| 2021/0088261 | A1* | 3/2021 | Chen | F25B 41/20 |

* cited by examiner

RETROFIT HEAT PUMP WATER HEATING SYSTEMS

FIELD OF THE DISCLOSURE

Examples of the present disclosure relate generally to water heating systems and, more specifically, to retrofit heat pump systems that include a plurality of evaporators to improve efficiency and decrease recovery time for water heating appliances.

BACKGROUND

Efficiency ratings have always been a main concern for water heater manufacturers. One reason for this can be attributed to the fact that the water heater is the second-most energy consuming appliance in a typical household, trailing only the heating and air conditioning system in the home. A hybrid heating system has been developed recently that aims to increase the efficiency of the system without compromising the heating efficiency and recovery time of the water heater. The hybrid system includes a traditional water tank, which can be either electric- or gas-powered, and an additional heat pump combined within a single system. The two systems (i.e., traditional heating and heat-pump heating) can work in tandem and adjust according to water heating needs. For example, the heat pump is highly efficient and can be used in an energy saving application. Electric or gas heating elements are less energy efficient but provide a great amount of heat. The two can be used at the same time to reduce recovery time when hot water is in highest demand.

The traditional hybrid system has a number of limitations regarding its ability to be widely adopted, however. First, gas-powered hybrid systems are not a universal solution for energy efficient water heating, because many localities have enacted regulations that ban the use of gas water heaters. As the reduction of greenhouse gas emissions becomes more of a concern over time, the use of gas-powered water heaters may become less prevalent.

Second, electric water heaters require a large power load to heat the heating elements within the water heating tank. Because of this, the water heater is connected to a 240V power supply to provide the power needed to heat the water. Typical hybrid system shares a common power supply, meaning the heat pump system also runs on 240V power supplies. Requiring a 240V power supply is also not optimal for widespread use.

Third, the hybrid system does not provide a solution for consumers that do not wish to purchase an entire water heating unit. Stated otherwise, a customer may to wish to increase the efficiency and/or heating capacity of their existing unit without having to purchase a new appliance. What is needed, therefore, is a system that can work with both gas and electric water heaters, that runs efficiently with a limited power load, and that can be used as a retrofit application to add heating capacity to existing water heaters, either at the manufacturer level by adding the system to existing designs or at the customer level by retrofitting an already-installed water heater.

BRIEF SUMMARY

These and other problems can be addressed by the technologies described herein. Examples of the present disclosure relate generally to water heating systems and, more specifically, to retrofit heat pump systems that include a plurality of evaporators to improve efficiency and decrease recovery time for water heating appliances.

The present disclosure provides a heat pump system for a water heater. The heat pump system can include a compressor, an evaporator system, a condenser subsystem, an exhaust fan, and a refrigerant conduit. The evaporator subsystem can include two evaporators, for example a first evaporator and a second evaporator. The condenser subsystem can be positioned near a tank of the water heater. The refrigerant conduit can include a first flow path extending downstream from the first evaporator, a second flow path extending downstream from the second evaporator, and a third flow path converging from the first flow path and the second flow path and extending to the compressor.

The condenser subsystem can include a plurality of condenser circuits, for example a first condenser circuit and a second condenser circuit. The condenser circuits can be positioned proximate the tank of the water heater. One or more of the condenser circuits can be coiled around the tank. Alternately or additionally, one or more of the condenser circuits can be placed within the water tank to directly heat the water therein.

The heat pump system can include a housing to enclose the various components of the system. The heat pump system can include a fan disposed in the housing. The fan can be placed so as to draw air across both evaporators; for example, the fan can be placed between the first evaporator and the second evaporator. The fan can be configured to exhaust air from around the first evaporator and the second evaporator and to a ventilation conduit associated with either an air conditioning system or a gas exhaust vent.

The heat pump systems described herein can operate at 120V. The heat pump system can operate to heat the water without the use of a heating element.

Each evaporator, for example the first evaporator and the second evaporator, can include a plurality of coil networks. To provide refrigerant to each of the coil networks, the heat pump system can include a refrigerant distributor in fluid communication with an expansion valve at one end and the plurality of coil networks at the other end. The refrigerant distributor can be internally symmetrical or nearly symmetrically to more evenly split or distribute refrigerant among the distribution conduits (i.e., the coil networks of the evaporators).

The present disclosure provides a retrofit heat pump for a water heater. The retrofit heat pump can include a housing, a plurality of evaporators, a compressor, a plurality of condenser circuits, and an expansion valve. The housing can be sized to attach to the water heater. The plurality of evaporators, the compressor, the plurality of condenser circuits, and the expansion valve can be similar to those features described above with respect to the heat pump system for the water heater. The retrofit heat pump system can provide an option to increase the efficiency of existing water heaters by decreasing the recovery time of the existing water heaters.

The retrofit heat pump can also include a fan, which can be configured to exhaust air from around the plurality of evaporators and to a ventilation conduit associated with either an air conditioning system or a gas exhaust vent, as described above.

The present disclosure provides a hybrid water heater system. The hybrid water heater system can include a water heater comprising a tank. The hybrid water heater can also include a heat pump system attachable to the water heater. The heat pump system can include an evaporator subsystem comprising a first evaporator and a second evaporator. The heat pump system can also include a compressor in fluid communication with the evaporator subsystem. The heat pump system can also include a condenser subsystem comprising a first condenser circuit and a second condenser circuit, the first condenser circuit and second condenser circuit being positioned proximate the tank. The first condenser circuit and the second condenser circuit can be similar to the circuits described above with respect to the heat pump system for the water heater.

The water heater and the heat pump can be configured to be powered by different power supplies. For example, the heat pump system can include an electrical connection configured to connect to and receive power from a 120V power outlet. This power connection can be provided even if the water heater includes an electrical connection configured to connect to and receive power from a 240V power outlet, or, alternatively, even if the water heater is a gas-powered water heater. In the case that the water heater is a gas-powered water heater, the heat pump can include a fan positioned between the first evaporator and the second evaporator and coaxial with the exhaust vent of the gas-powered water heater.

These and other aspects of the present disclosure are described in the Detailed Description below and the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner. In the drawings.

DETAILED DESCRIPTION

A hybrid water heater includes a traditional water heating system and a heat pump to add heat directly to the tank. Using an electric-hybrid water heater as an example, the water heater typically includes two heating elements placed within the water tank to heat the water, and a condenser of the heat pump wraps around the tank to further warm the tank. Similar is true for a gas-hybrid water heater, though instead of electric heating elements, the burner is typically located at the bottom of the tank to warm the water, and an exhaust flue runs through the interior of the tank. As described above, certain limitations exist with current hybrid designs.

As for the electric-hybrid, the system as a whole requires a large power load. The electric heating elements require a great amount of current to heat via resistive heating, and that current is ordinarily provided by a 240V power supply. The heat pump feature of the system typically runs on the same power supply and requires even more amperage. This, of course, is not optimal for homes (e.g., older homes in the United States) that do not have access to 240V power outlets or that cannot provide the necessary amperage to operate both the electric elements and the heat pump. For example, it is common for older homes to be limited to 120V and to have a fuse panel limiting the actual delivered current to approximately 60 amps. To this end, an additional appliance running on 240V and requiring excessive amperage may not be feasible for many homes. As for the gas-hybrid, concerns exist about whether gas-powered heaters will remain prevalent for years to come. As more regulations are passed to limit greenhouse gas emissions, the adoption of gas-powered water heaters is trending downward in some regions.

Finally, regardless of whether the system is gas- or electric-powered, a need exists for a retrofit heat pump system than can work with existing designs. A retrofit heat pump system can be used to decrease the recovery time of an existing water hear, regardless of whether the existing heater is an electric or a gas heater.

Various systems and methods are disclosed for heat pump systems that can be used to heat the water in a water heater tank, and example systems will now be described with reference to the accompanying figures.

Figure 1:
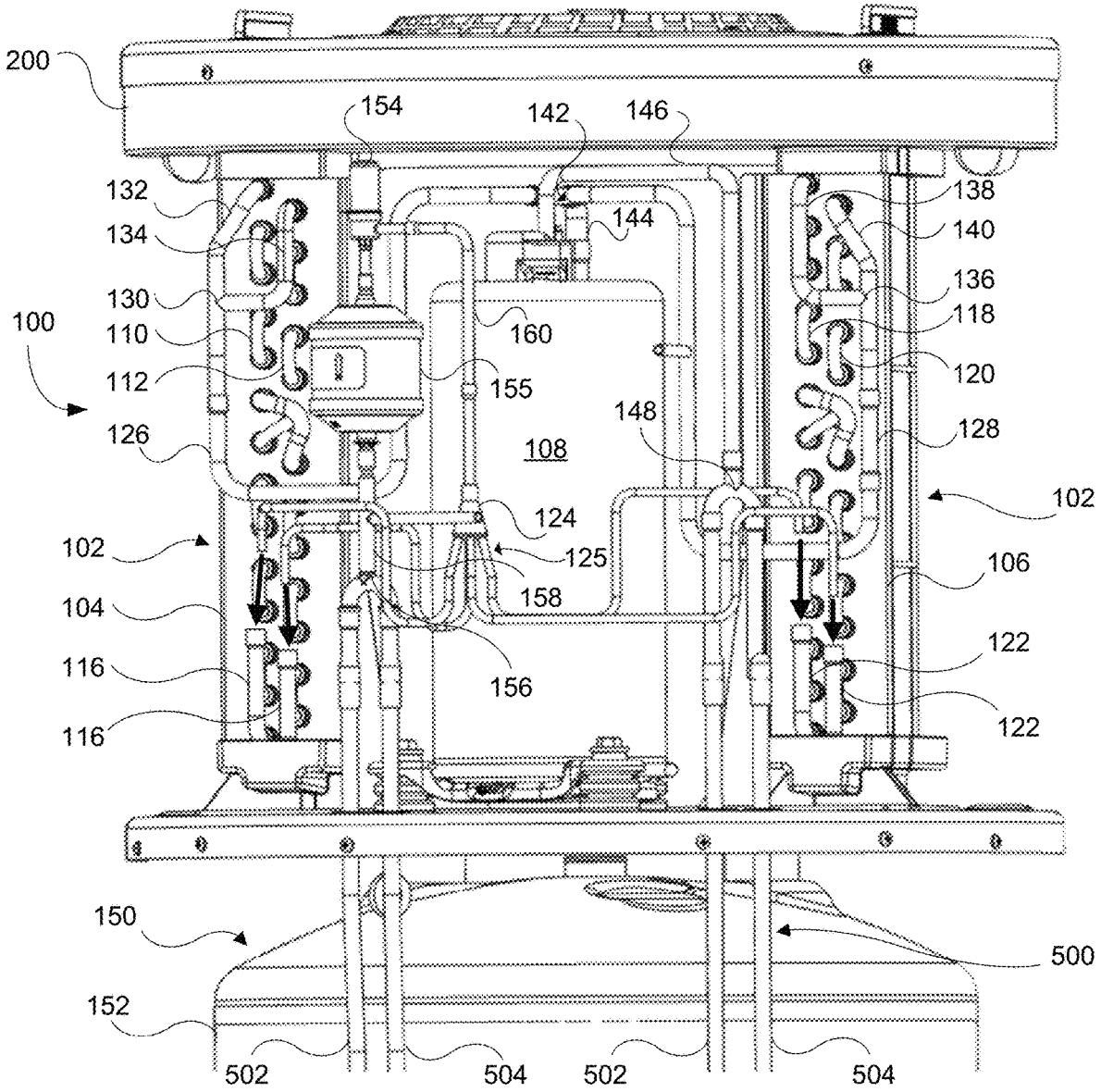
FIG. 1 is a front view of a heat pump system, in accordance with the present disclosure.

FIG. 1 is a front view of an example heat pump system 100 with a side wall omitted for clarity. The heat pump system 100 can include an evaporator subsystem 102 that can include a plurality of evaporators. The example view shown in the following figures includes a first evaporator 104 and a second evaporator 106. It will be appreciated, however, that more than two evaporators can be included in the evaporator subsystem 102; when reference is made to a first evaporator 104 and a second evaporator 106 below, it will be understood that the disclosed technology includes more than two evaporators. As described above, an aim of the present disclosure is to provide a heat pump system 100 that runs efficiently with a minimal electrical load. To do so, the present systems and devices employ a plurality of evaporators to increase the total surface area of the evaporator and, thus, increase the amount of heat that can be absorbed by refrigerant in said evaporators. As will be described in greater detail below, the plurality of evaporators of the evaporator subsystem 102 can be in fluid communication with a single compressor 108 to thereby further limit the electrical load required to heat the refrigerant.

The evaporators, e.g., the first evaporator 104 and the second evaporator 106, can have any number of evaporator designs, for example and not limitation microchannel, tube-fin, tube (including micro-tube and mini-tube evaporators), roll bond, and the like. In any case, one or more of the evaporators 104,106 can include more than one refrigerant path disposed within the evaporator 104,106 to further increase the surface area and, thus, refrigerant heating. For example, in the case of a tube evaporator, one or more of the evaporators 104,106 can include more than one tube or coil network within the evaporator(s) 104,106 (e.g., two parallel tube paths). Referring to FIG. 1 for illustration, the first evaporator 104 can include a first coil network 110 and a second coil network 112, which can each be supplied refrigerant by coil inlet(s) 116 located at an end of the first coil network 110 and/or second coil network 112; in addition, or as an alternative, the second evaporator 106 can include a third coil network 118 and a fourth coil network 120, which can each be supplied refrigerant by coil inlet(s) 122 located at an end of the third coil network 118 and and/or fourth coil network 120. As will be described in greater detail below, each coil inlet 116,122 can be in fluid communication with a refrigerant distributor 124 that provides equal and/or required amounts of refrigerant to each coil inlet 116,122 to ensure liquid refrigerant enters the coil network(s) 110,112,118,120 and vaporized refrigerant leaves the network(s).

As described above, the heat pump system 100 can have one or more compressors 108 that receive the vaporized refrigerant from the evaporator subsystem 102 and compresses the refrigerant to increase the heat of the refrigerant before it passes to a condenser subsystem 500, which described in greater detail below. The example heat pump system 100 shown in FIG. 1 includes a single compressor 108, though more than one compressor 108 can be employed within the present systems. A single compressor 108, however, can decrease the electrical load required of the heat pump system 100, thereby relying mostly on the multi-evaporator evaporator subsystem 102 to perform a greater proportion of the refrigerant heating. A single-compressor 108 system can also ensure that the heat pump system 100 can run on a power supply that is available in the home (e.g., 120V and 15 A or less).

Figure 8:
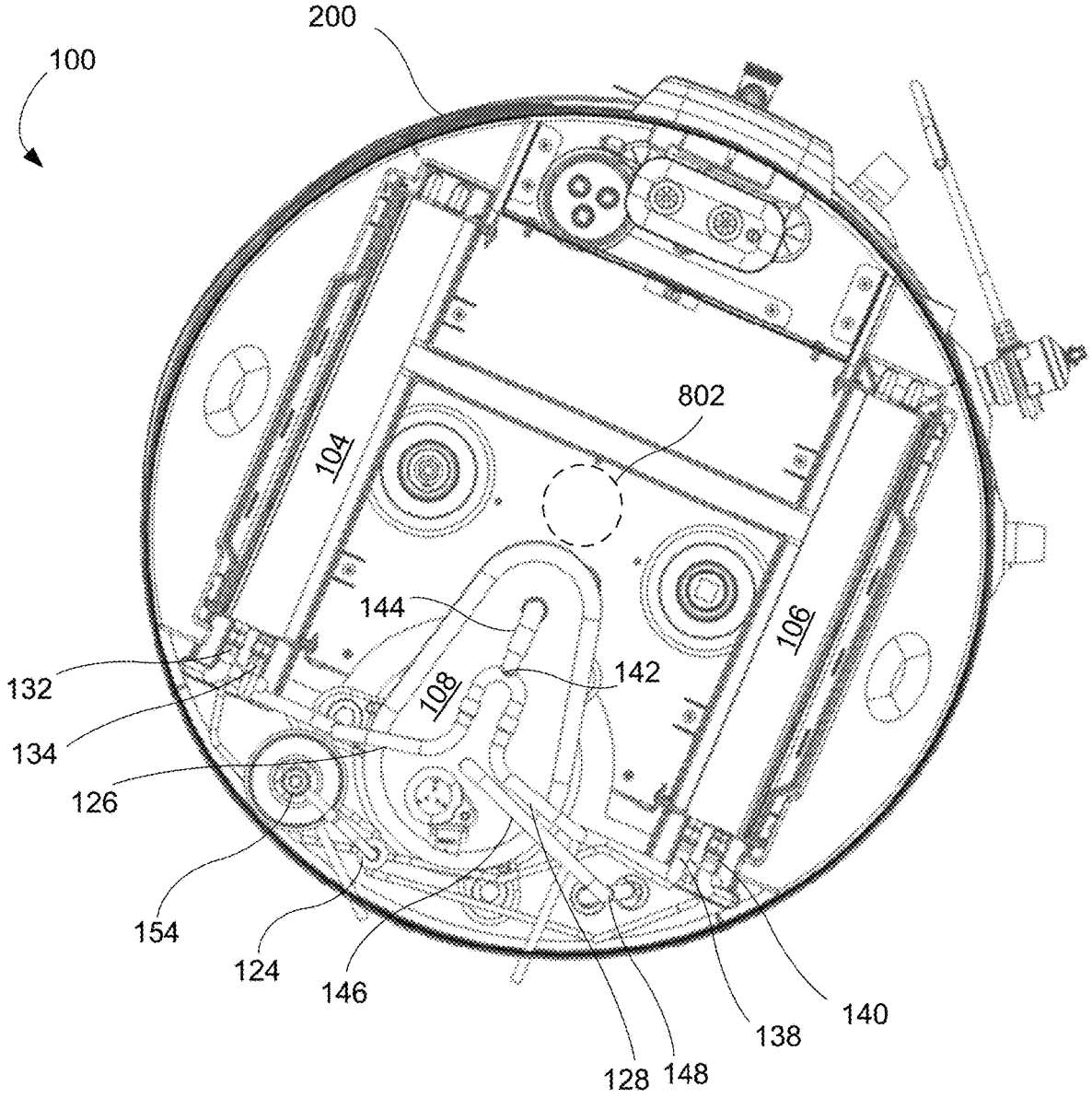
FIG. 8 is a top cutaway view of a heat pump system, in accordance with the present disclosure.

The compressor 108 can receive the refrigerant from the evaporator subsystem 102 via one or more evaporator return conduits that create a flow path between the coil network(s) 110,112,118,120 and the compressor 108. Referring to the two-evaporator system shown in FIG. 1, the compressor 108 can receive refrigerant from the first evaporator 104 via a first evaporator return 126. In systems that include more than one coil networks in an evaporator, the first evaporator return 126 can include a first convergence 130 that combines a first exit conduit 132 (associated with the first coil network 110) and a second exit conduit 134 (associated with the second coil network 112) into a single flow path at the first evaporator return 126. Similarly, the compressor 108 can receive refrigerant from the second evaporator 106 via a second evaporator return 128. The second evaporator return 128 can include a second convergence 136 that combines a third exit conduit 138 (associated with the third coil network 118) and a fourth exit conduit 140 (associated with the fourth coil network 120) into a single flow path at the second evaporator return 128. In heat pump systems 100 that have a single compressor 108, the first evaporator return 126 and the second evaporator return 128 can join at a compressor convergence 142 (a top/unobstructed view of the compressor convergence 142 is shown in FIG. 8). Once joined at the compressor convergence 142, a single flow path into the compressor 108 can be created at a compressor inlet 144. In systems that include more than one compressor 108, the first evaporator return 126 can be in fluid communication with a first compressor 108 and the second evaporator return 128 can be in fluid communication with a second compressor 108, as a non-limiting example.

Once the refrigerant is compressed by the one or more compressors 108, the heated and compressed refrigerant can exit the compressor(s) 108 at a compressor outlet 146. The compressor outlet 146 can then provide the superheated refrigerant to a condenser subsystem 500. The condenser subsystem 500 can include the condenser network that heats the water in the water tank 150. The condenser subsystem 500 can include one or more condenser circuits that heat the water. The present discourse describes systems having two condenser circuits, for example a first condenser circuit 502 and a second condenser circuit 504. The dual-circuit design can decrease the refrigerant pressure drop through the condenser subsystem 500, providing a better system efficiency and coefficient of performance for a given thermal capacity. In cases that include two condenser circuits 502,504, the two circuits can each receive refrigerant from a condenser split 148 disposed along the flow path of the compressor outlet 146. Alternatively, the compressor 108 could include two outlets to provide refrigerant to both condenser circuits 502,504 (e.g., one outlet for the first condenser circuit 502 and one outlet for the second condenser circuit 504). In yet another alternative, the heat pump system 100 could include two compressors 108 to provide refrigerant to both condenser circuits. As described above, however, having a single compressor 108 can decrease the electrical load of the system.

The condenser subsystem 500 can heat the water in the water tank 150 by providing condenser circuits 502,504 that coil around the outer surface 152 of the water tank 150 (as shown in FIG. 1, and as shown in greater detail with reference to FIGS. 5-7) and/or by running one or both of the condenser circuits 502,504 directly into the water tank 150. One or more openings can be provided in the top of the water tank 150 for insertion of the condenser circuits 502,504, and the opening can be covered such that the water tank 150 is fully sealed.

After the condensers circuit(s) 502,504 of the condenser subsystem 500 provide heat to the water tank 150, the cooled and liquified refrigerant can reenter the heat pump system 100 and flow to an expansion valve 154. In systems with two condenser circuits 502,504, the two circuits can join at an expansion convergence 156, and flow into the expansion valve 154 via an expansion inlet 158. As will be appreciated, the expansion valve 154 can ensure that the proper amount of liquified refrigerant is supplied to each of the evaporators 104,106 in the evaporator subsystem 102, such that liquified refrigerant enters the evaporator(s) and vaporized refrigerant exits the evaporators(s). As described above, the supply of refrigerant can also be facilitated by a refrigerant distributor 124 that provides equal and/or required amounts of refrigerant to each of the coil inlet(s) 116,122. The refrigerant distributor 124 can be in fluid communication with the expansion valve 154 via an expansion outlet 160 at a first end and can be in fluid communication with the coil inlet(s) 116,122 at a second end. Distribution conduits 125 can supply the refrigerant to the coil inlet(s) 116,122, as will be described in greater detail with reference to FIG. 10. The heat pump system 100 can also include a filter dryer 155 placed between the expansion inlet 158 and the expansion valve 154.

Figure 2:
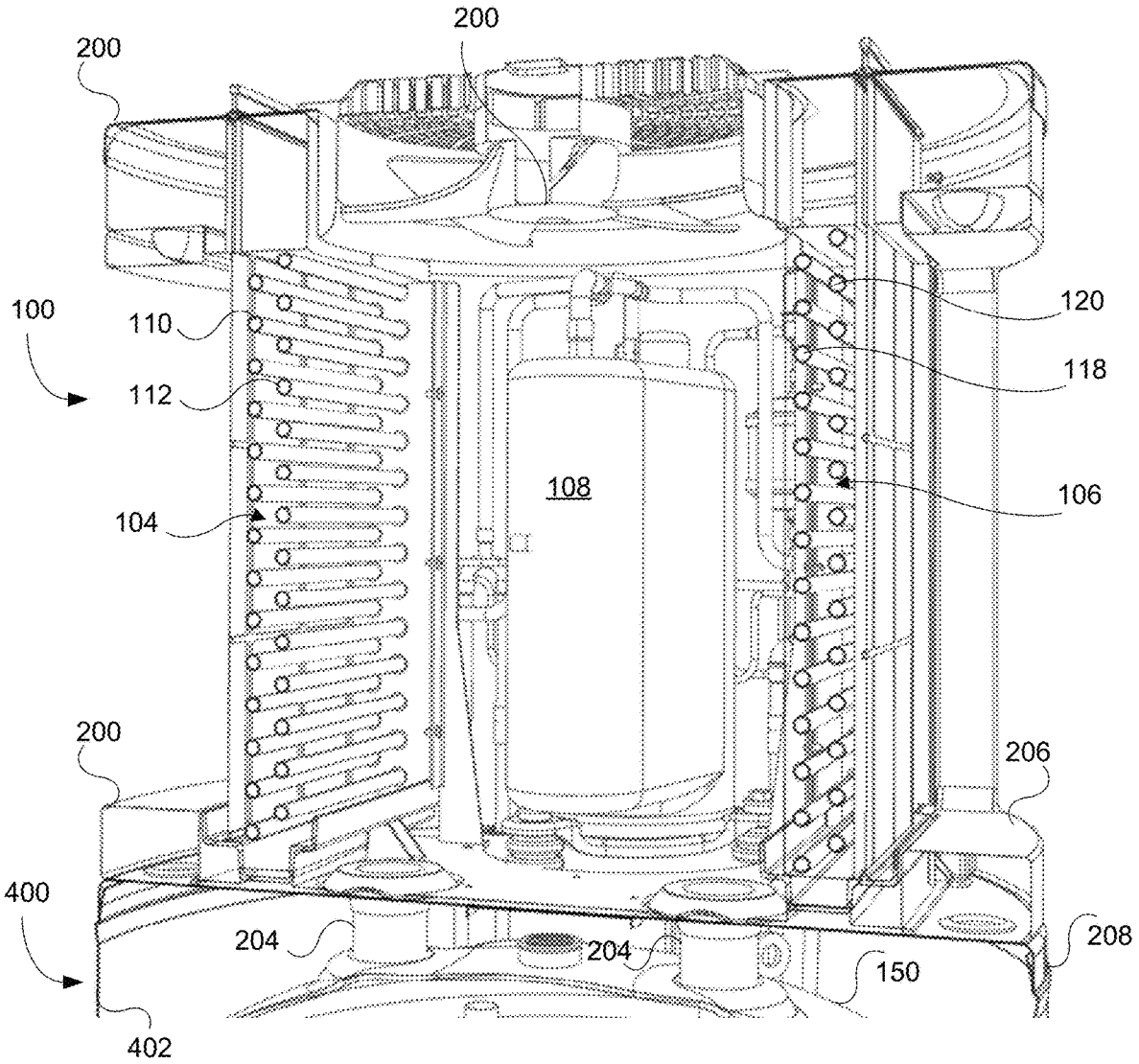
FIG. 2 is a sectional view of a heat pump system, in accordance with the present disclosure.

FIG. 2 is a sectional view of an example heat pump system 100. The components described herein for the heat pump system 100 can be included within a housing 200. The housing 200 can include one or more fans 202 to move air across the evaporator(s) 104,106. The fan(s) 202 can be positioned at any location within the housing 200. For example, two fans 202 can be placed within the housing 200 in a system that has two evaporators 104,106, each fan dedicated to moving one air across its respective evaporator 104,106. Alternatively, and as shown in FIG. 2, the heat pump system 100 can include a single fan 202. A single fan 202 system can provide certain efficiencies to the heat pump system 100. Having one fan 202 can decrease the electrical load required for the heat pump system 100. The fan 202 can be placed centrally between the one or more evaporators in the housing 200, and this can ensure cool, dehumidified air exits the system at a single location. As will be described in greater detail with reference to FIG. 9, this enables the system to provide the cool air via a ventilation conduit 902 to a downstream feature 904, such as an air conditioning system of the house. This example can, therefore, reduce the burden placed on the air conditioning system of the home and further reduce the electrical consumption of the appliances in the home. In the case of gas water heater systems, for example, the fan 202 can be placed in the top of the housing 200 such that the location of the fan 202 corresponds to an exhaust vent for the water heater. FIG. 8 shows an example location of an exhaust opening 802 in the housing 200, positioned such that a centrally-located fan 202 can vent the combustion byproduct. In this example, and referring again to FIG. 9, the ventilation conduit 902 can be an exhaust ductwork and the downstream feature 904 can be an exhaust vent outside the home.

Referring again to FIG. 2, the housing 200 of the heat pump system 100 can be attachable to the water heater 400. By attaching the housing 200 to a water heater 400, the heat pump system 100 can conserve space for the water heating system and can also enable the condenser subsystem 500 to be covered to protect from injury. The housing 200 can be attached to the water tank 150 via pedestals 204 located between the housing 200 and the water tank 150. The pedestals 204 can be permanently attached to the housing 200 and can rest upon the top of the water tank 150, for example. A bottom of the pedestals 204 can include rubber grommets or pads to prevent the housing 200 from sliding on the water tank 150 or water heater 400. Alternatively, the pedestals 204 can also be permanently attached to the water tank 150 or water heater 400.

The housing 200 can also include an outer cover 206 that protects the internal components of the heat pump system 100. The outer cover 206 can include a cover lip 208 that is positionable upon a water tank insulative housing 402. Positioning the cover lip 208 upon the water tank insulative housing 402 can facilitate attachment of the housing 200 to the water heater 400, and the cover lip 208 can be used in addition to and as an alternative to the pedestals 204 to ensure the housing 200 remains attached to the water heater 400.

In systems that include two evaporators 104,106, the evaporators 104,106 can be placed within the housing 200, for example parallel within the housing 200. This can help ensure uniform air flow around each of the evaporators 104,106 by the single fan 202. It is not required that the evaporators 104,106 be placed in parallel within the housing, however. For example, some systems can include more than one fan 202, meaning the evaporators 104,106 can be placed at any location without consideration of a shared fan. Additionally, more than two evaporators 104,106 can be placed in a single system, and it is contemplated that this arrangement may require one or more of the evaporators 104,106 to be placed in different planes so as to conserve space within the housing 200.

Figure 3:
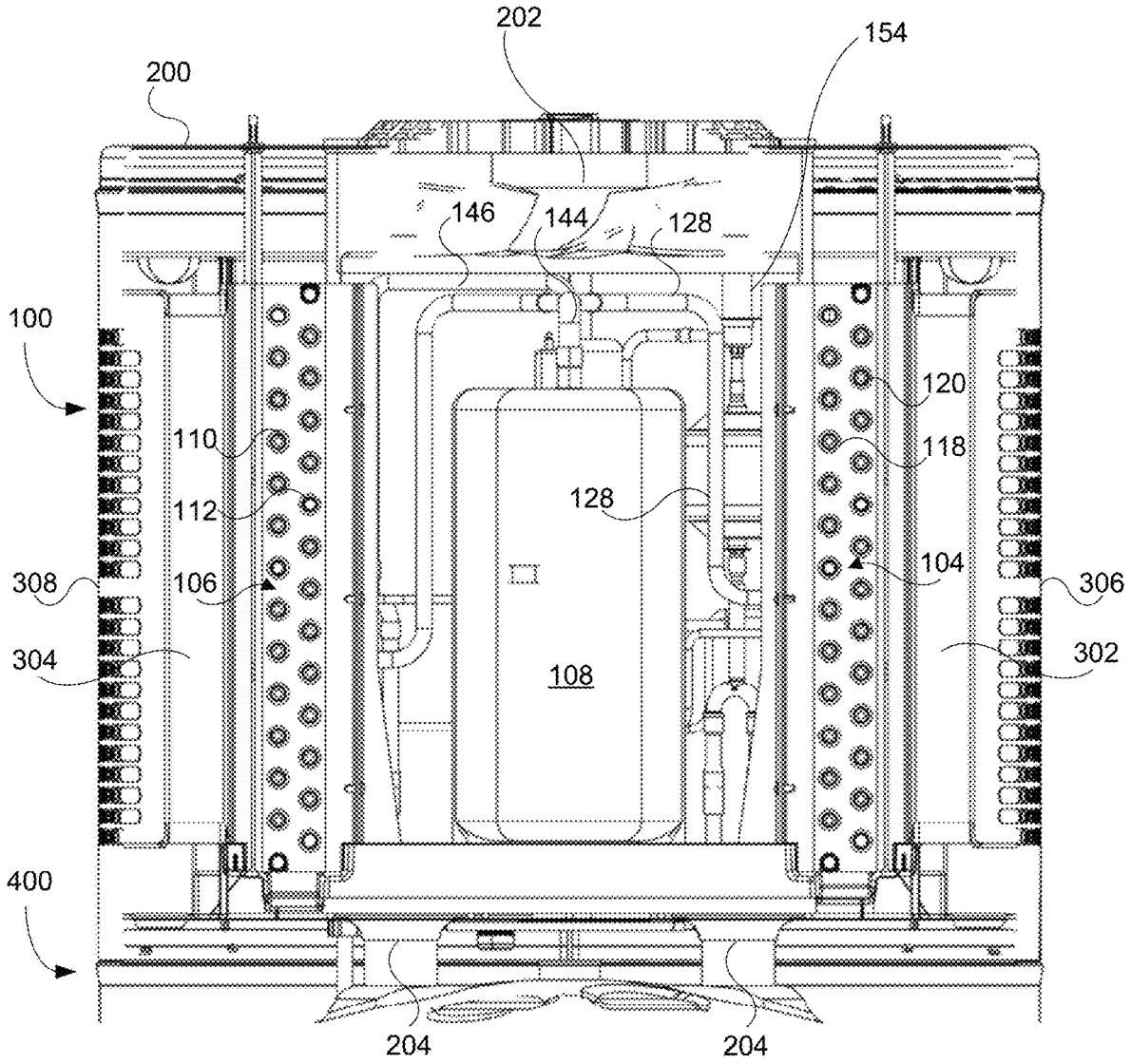
FIG. 3 is a rear sectional view of a heat pump system, in accordance with the present disclosure.

FIG. 3 is a rear sectional view of an example heat pump system 100, wherein the outer cover 206 is partially removed to show the internal components of the heat pump system 100. The housing 200 can include one or more filters, and the quantity can depend on the number of evaporators within the evaporator subsystem 102. The example shown in FIG. 3 includes two evaporators, a first evaporator 104 and a second evaporator 106. The system can include a first filter 302 to filter air flow around the first evaporator 104, and a second filter 304 to filter air flow around the second evaporator 106. The housing 200 can additionally include a first filter cover 306 to both house the first filter 302 and to enable a user to have access to replace the first filter 302; the system can similarly have a second filter cover 308.

Figure 4:
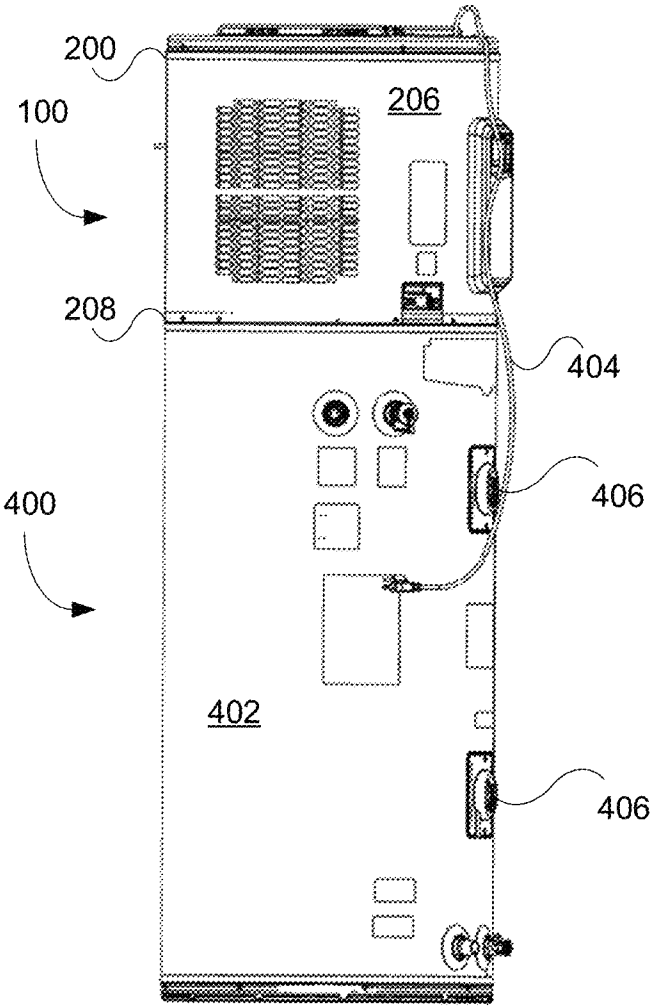
FIG. 4 is a side view of a heat pump system attached to a water heater, in accordance with the present disclosure.

FIG. 4 is a side view of an example heat pump system 100 attached to a water heater 400. The image shows how a housing 200 of the heat pump system 100 can align with a water tank insulative housing 402 on the water heater 400. The lip 208 of the housing 200 can align with the water tank insulative housing 402 to ensure one component does not slide laterally with respect to the other component. It is contemplated that a variety of heat pump systems 100 can be designed to match the shapes pre-existing water tank insulative housing(s) 402, such that a heat pump system 100 can be selected to fit upon the pre-existing water heater 400.

The heat pump system 100 can include a power cord 404 that can plug into an electrical outlet to power the heat pump system 100. The power cord 404 can correspond to an ordinary 240V or 120V electrical outlet. This is a benefit over previous electric hybrid water heater systems, as prior systems typically required the heat pump component to run on a shared electrical connection with the water heating system. This meant that the entire hybrid system of existing systems required enough amperage to power both the heat pump and the electrical elements 406 that heat the water. Typically, the electrical elements 406 are the most energy-intensive components of the water heating system. With the heat pump systems 100 of the present disclosure, however, the heat pump system 100 can use a separate power supply than the water heater system, thereby spreading the electrical loads to different outlets. This can be a significant advantage for older homes that have low amperage ratings or are limited to 120V. Furthermore, since the heat pump system requires minimal electrical components (i.e., as few as two—the compressor 108 and a fan 202), the system can be designed to run on a 120V power supply. It is also notable that the heat pump system 100 does not require electrical elements 406 (i.e., for electrical resistive heating), thereby further limiting the electrical requirements of the system.

Figure 5:
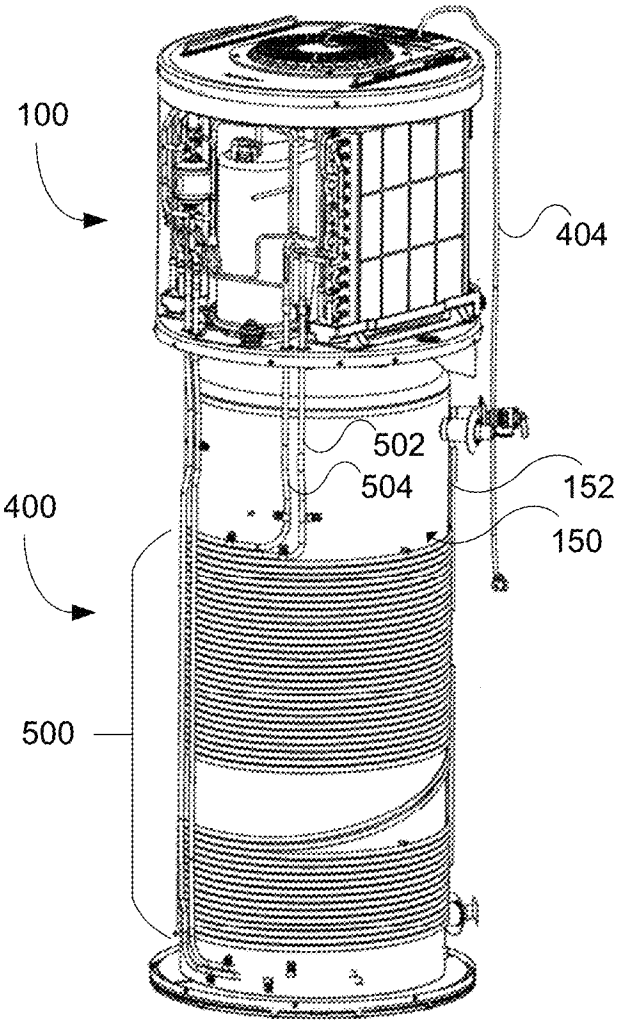
FIG. 5 is a perspective view of a heat pump system attached to a water heater, in accordance with the present disclosure.

FIG. 5 is a perspective view of a heat pump system 100 attached to a water heater 400, wherein the cover 206 of the housing 200 and the water tank insulative housing 402 have been removed to show the condenser subsystem 500. The view shows how the heat pump systems 100 described herein can be used as a retrofit system for existing water heaters 400. The water tank insulative housing 402 can be removed from a water heater 400 and the condenser subsystem 500 can be coiled around the outer surface 152 of the water tank 150. The example condenser subsystem 500 in FIG. 5 shows two circuits for the condenser subsystem 500, including a first condenser circuit 502 and a second condenser circuit 504. The first condenser circuit 502 and the second condenser circuit 504 can be coiled around the outer surface 152 of the water tank 150 to provide conductive heating to the water tank 150. It is contemplated that the first condenser circuit 502 and the second condenser circuit 504 can be wrapped in parallel around the water tank 150 from a position near the top of the water tank 150 to a position near the bottom of the water tank 150. It has been shown that an example design in accordance with the disclosed technology and having 48 wraps (i.e., 24 wraps of the first condenser circuit 502 and 24 wraps of the second condenser circuit 504) can produce a recovery time of less than one hour, whereas heat pump water heaters of the prior art require up to three hours to recover. Alternatively or in addition to wrapping the condenser subsystem 500 around the water tank 150, one or both of the first condenser circuit 502 and the second condenser circuit 504 can instead be disposed within the water tank 150 to directly heat the water within the water tank 150. After the condenser subsystem 500 is added to the water tank 150, the water tank insulative housing 402 can be added back to the water heater 400 to insulate the condenser subsystem 500.

Figure 7:
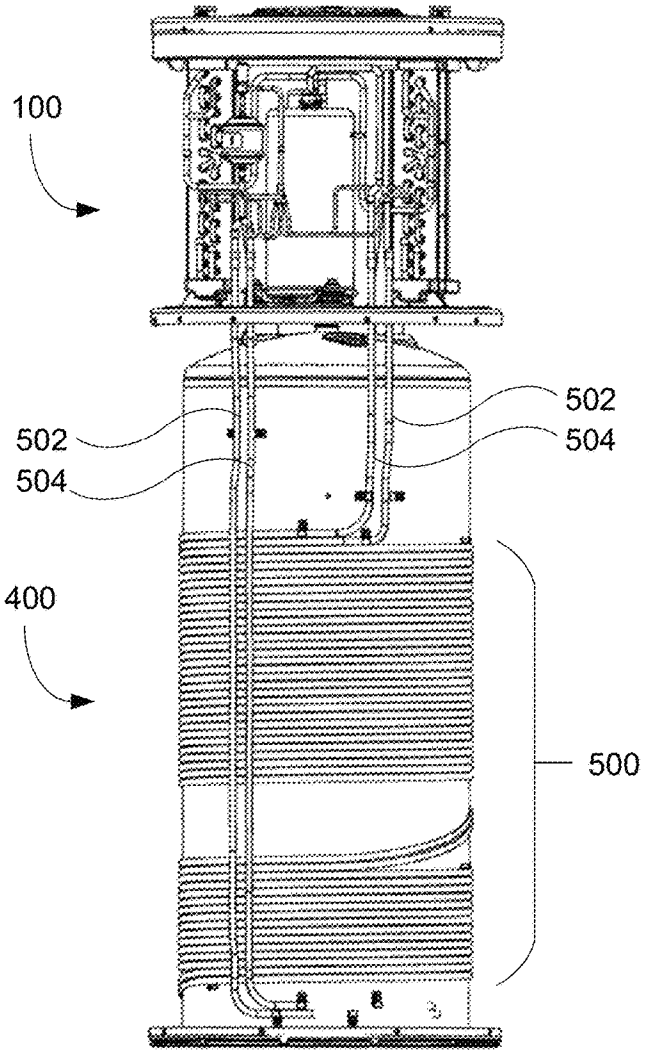
FIG. 7 is a front view of a heat pump system attached to a water heater, in accordance with the present disclosure.
Figure 6:
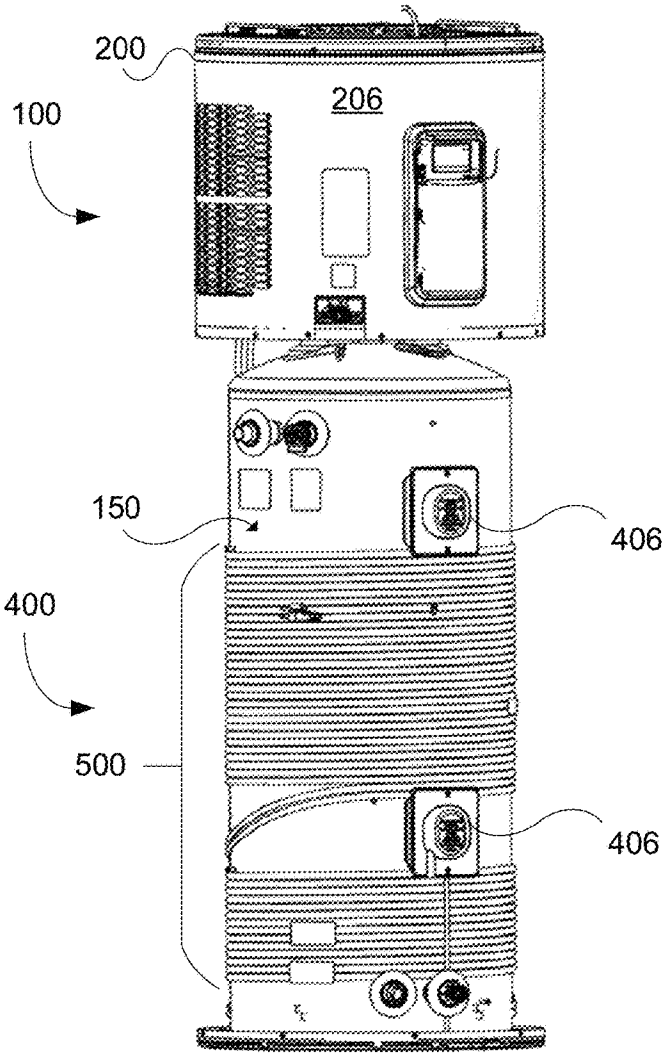
FIG. 6 is a side view of a heat pump system attached to a water heater, in accordance with the present disclosure.

FIGS. 6 and 7 provide alternative views of the heat pump system 100 attached to a water heater 400. FIG. 6 is a side view of a heat pump system 100 attached to a water heater 400 wherein the outer cover 206 of the housing 200 is attached to the heat pump system; FIG. 7 is a front view of a heat pump system 100 attached to a water heater 400 wherein the outer cover 206 and the water tank insulative housing 402 are removed to show various internal components.

FIG. 8 is a top cutaway view of an example heat pump system 100. This view provides an unobstructed view of the conduits flowing into and out of the compressor 108. As described above, the heat pump system 100 can be used with an existing gas-powered water heater 400. To this end, the housing 200 can include an exhaust opening 802, which can be a hole and/or a conduit passing through the housing 200, to enable the byproduct of the combustion in the water heater burner to exit through the heat pump system 100. The fan 202 can also be centrally placed such that the combustion byproduct can be discharged to existing exhaust ducts.

Figure 9:
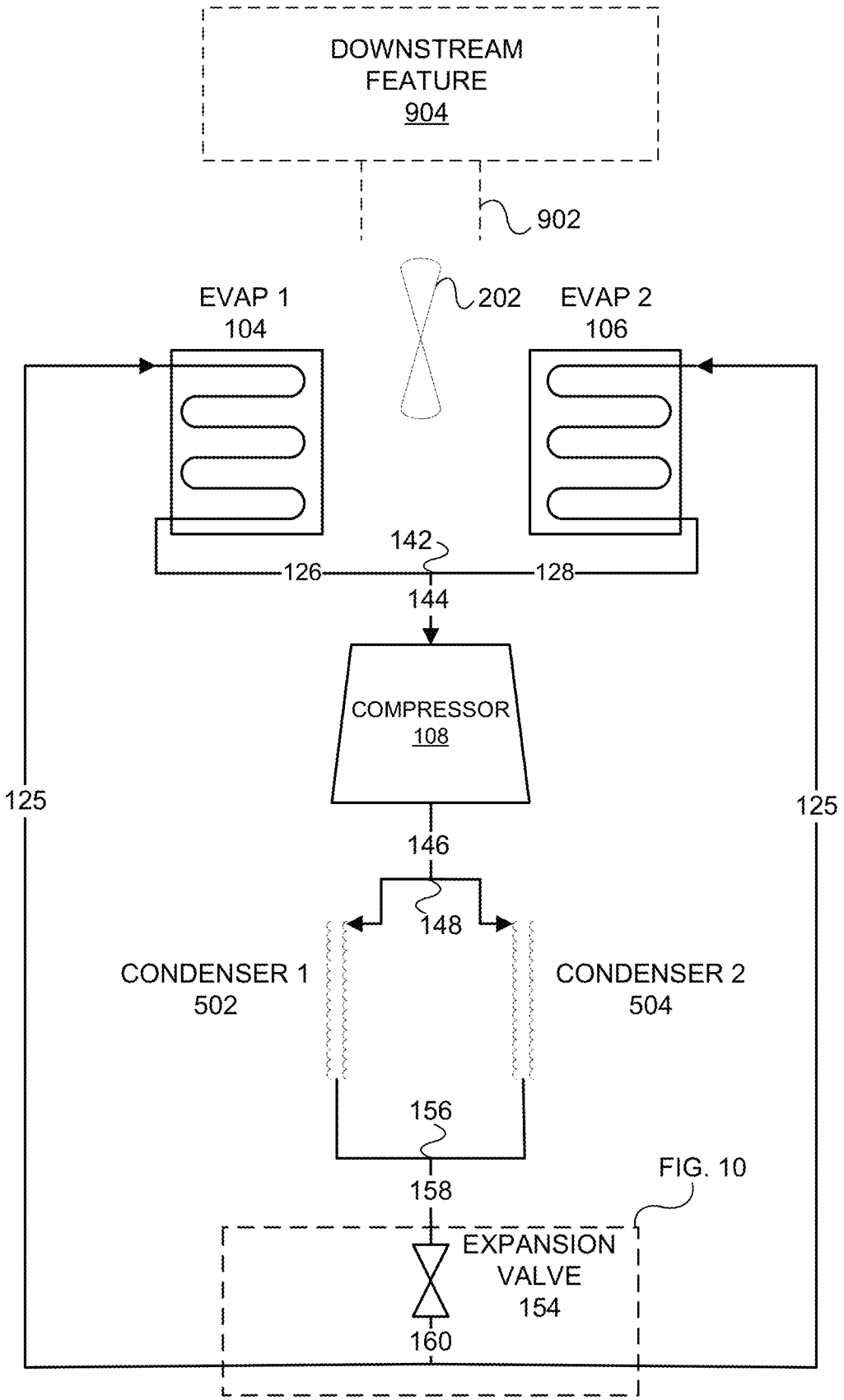
FIG. 9 is a schematic of a heat pump system, in accordance with the present disclosure.

FIG. 9 is a schematic of an example heat pump system 100. The schematic shows the refrigerant path of the system, as well as external components (e.g., the downstream feature(s) 904 described above) that can be used with the system. Referring to the refrigerant path, liquid refrigerant can enter the evaporator subsystem 102 (e.g., at the first evaporator 104 and the second evaporator 106). The fan 202 can pull room-temperature air across the first evaporator 104 and the second evaporator 106 so that the refrigerant can remove heat from the room-temperature air. The cooled and dehumidified air can then be exhausted out of the heat pump system 100 by the fan 202. The cooled air can merely be pumped into the storage room or alcove that stores the water heater, thereby cooling the air in the room or alcove as the water is heated. The cooled air can be expelled into a ventilation conduit 902. As described above, the ventilation conduit 902 can include ductwork that feeds into a downstream feature 904. The downstream feature 904 can include the heating and air conditioning ductwork for the home. Thus, the heat pump system 100 can assist in cooling the home in addition to warming the water of the water tank 150. Alternatively or additionally, the ventilation conduit 902 can be associated with an exhaust duct for the gas water heater, as described above.

After the refrigerant is vaporized by the warm air, the vaporized refrigerant can exit the evaporator(s) 104,106 (e.g., via the first evaporator return 126 and the second evaporator return 128). The refrigerant can then combine into a single flow path at the compressor convergence 142 and can then enter the compressor 108 via the compressor inlet 144. The refrigerant can then be compressed, and thus heated, and can exit the compressor 108 at the compressor outlet 146. The superheated refrigerant can then be transferred to the condenser subsystem 500. In the example shown in FIG. 9, the condenser subsystem 500 includes two condenser circuits (e.g., a first condenser circuit 502 and a second condenser circuit 504).

The condenser circuit(s) 502,504 can then heat the water in the tank (e.g., water tank 150) via the heated refrigerant. This can be completed by heating the outer surface (e.g., outer surface 152) of the tank via condenser circuit 502,504 coils wrapped around the tank (e.g., as shown in FIG. 5). Alternatively, one or more of the condenser circuit(s) 502, 504 can be placed into the tank such that the water is heated directly.

After the refrigerant passes through the condenser circuit(s) 502,504, the re-liquified refrigerant can merge (e.g., at the expansion convergence 156) and enter an expansion valve (e.g., expansion valve 154). The expansion valve 154 can reduce the pressure of the liquid refrigerant so as to ensure the refrigerant is properly vaporized in the evaporator(s) 104,106. After the refrigerant exits the expansion valve 154, the flow path can split once again (e.g., at the refrigerant distributor 124), and the flow path can start again at the evaporator(s) 104,106. For evaporator(s) 104,106 that include more than one coil network (e.g., coil networks 110,112,118,120), the refrigerant distributor 124 can include a plurality of distribution conduits 125 to provide refrigerant to each of the coil networks 110,112,118,120.

Figure 10:
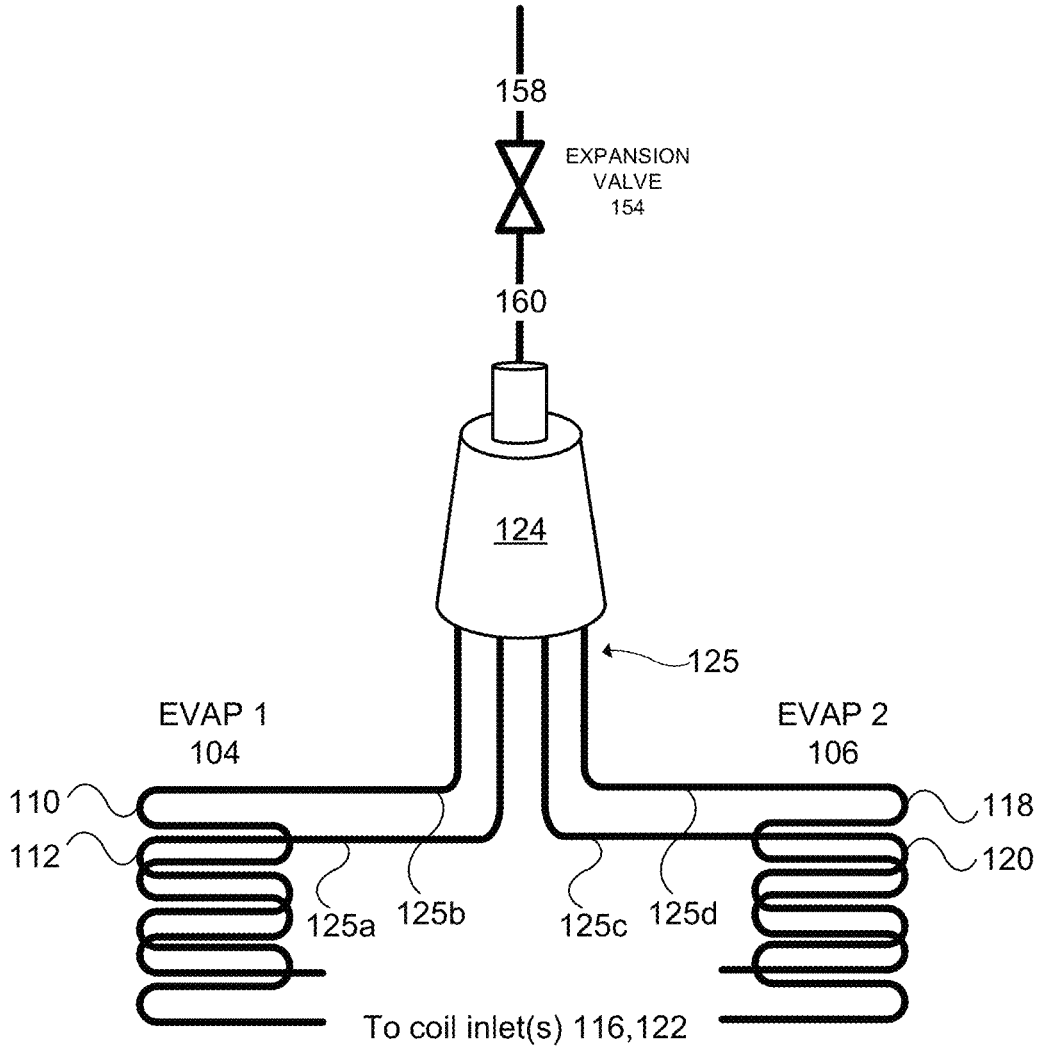
FIG. 10 is a schematic of a refrigerant distributor flow path, in accordance with the present disclosure.

FIG. 10 is a schematic of an example refrigerant distributor 124 flow path. As described above, an evaporator subsystem 102 can include a plurality of evaporators (e.g., a first evaporator 104 and a second evaporator 106), and each of the plurality of evaporators 104,106 can have a plurality of coil networks (e.g., coil networks 110,112,118,120). To this end, it can be important to the efficiency of the system to ensure the proper and desired amount of refrigerant enters each of the coil networks. In prior systems, there was little need for a refrigerant distributor 124 that splits a refrigerant flow into more than two flow paths. This is because prior heat pump systems did not include a plurality of evaporators. At most, prior systems may have required a single splitter that split the fluid path from the expansion valve in order to feed the coil systems of a single evaporator. Even then, the splitters used in prior systems to bifurcate a flow path between an expansion valve and a single evaporator were considerably inefficient. Many of the splitters were asymmetrically shaped like the lowercase letter "y," meaning one of the conduits forks off of the main conduit. With this design, the conduit that forked off typically had a lower volume of refrigerant flow, thus decreasing the efficiency of the evaporator supplied by that conduit.

With the present systems, more than one evaporator may be supplied by a splitter (or distributor) placed between the expansion valve and the evaporators. Care should be taken, therefore, to ensure the proper amount of refrigerant is supplied to each of the coil networks (e.g., coil networks 110,112,118,120). The refrigerant distributor 124 of the present disclosure presents a solution to this problem. The refrigerant distributor 124 can include a single inlet in communication with the expansion outlet 160. The refrigerant distributor 124 can include a hollow interior to enable the refrigerant to pool and combine into a single source before the refrigerant exits the refrigerant distributor 124 at distribution conduits 125. The refrigerant distributor 124 can be internally symmetrical or nearly symmetrically to more evenly split or distribute refrigerant among the distribution conduits 125. The distribution conduits 125 can be in fluid communication with the coil networks 110,112,118,120 via the coil inlet(s) 116,122. For example, a first distribution conduit 125*a* can be in fluid communication with the first coil network 110; a second distribution conduit 125*b* can be in fluid communication with the second coil network 112; a third distribution conduit 125*c* can be in fluid communication with the third coil network 118; and a fourth distribution conduit 125*d* can be in fluid communication with the fourth coil network 120. As will be appreciated, the evaporators in this system are in parallel, meaning they share a common refrigerant supply via splits in the system (e.g., the refrigerant distributor a one end and the compressor convergence 142 at another end.

Throughout this disclosure, reference is made to refrigerants that can be used within the disclosed heat pump systems 100. It will be appreciated that any refrigerant can be used within the systems. Since the heat pump systems 100 can be installed within the home of the customer, it is contemplated that the refrigerant chosen that accommodates interior installation. These refrigerants can include, but are not limited to, R134a, R410a, R22, R407C, R404A, and the like.

It should also be noted that, as used in the specification and the appended claims, the singular forms "a," "an," and "the" include plural references unless the context clearly dictates otherwise. References to a composition containing "a" constituent is intended to include other constituents in addition to the one named.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

While the present disclosure has been described in connection with a plurality of exemplary aspects, as illustrated in the various figures and discussed above, it is understood that other similar aspects can be used, or modifications and additions can be made, to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter. Additionally, the components described herein may apply to any other component within the disclosure. Merely discussing a feature or component in relation to one embodiment does not preclude the feature or component from being used or associated with another embodiment.

What is claimed is:

1. A heat pump system for a water heater comprising:
- a compressor;
- an evaporator subsystem comprising a first evaporator and a second evaporator;
- a condenser subsystem proximate a tank of the water heater, the condenser subsystem comprising a first condenser circuit and a second condenser circuit proximate the tank of the water heater, the first condenser circuit and the second condenser circuit being configured to (a) operate simultaneously and (b) receive refrigerant from the compressor;
- an exhaust fan; and
- a refrigerant conduit comprising:
  - a first flow path extending downstream from the first evaporator;
  - a second flow path extending downstream from the second evaporator; and
  - a third flow path converging from the first flow path and the second flow path and extending to the compressor.

2. The heat pump system of claim 1, wherein the first condenser circuit and the second condenser circuit are disposed within the tank.

3. The heat pump system of claim 1, wherein the first condenser circuit and the second condenser circuit are disposed on an outer surface of the tank and are coiled around the tank.

4. The heat pump system of claim 1, wherein the heat pump system operates at 120V and does not comprise a heating element.

5. The heat pump system of claim 1, further comprising:
- a housing; and
- a fan disposed between the first evaporator and the second evaporator.

6. The heat pump system of claim 5, wherein the fan is configured to exhaust air (i) from around the first evaporator and the second evaporator and (ii) to a ventilation conduit associated with either an air conditioning system or a gas exhaust vent.

7. The heat pump system of claim 1, wherein:
- the first evaporator comprises a first coil network and a second coil network;
- the second evaporator comprises a third coil network and a fourth coil network; and
- the heat pump system further comprises:
  - an expansion valve; and
  - a refrigerant distributor comprising a first end in fluid communication with the expansion valve and a second end comprising four distribution conduits, each distribution conduit of the four distribution conduits in fluid communication with one of the first coil network, the second coil network, the third coil network, or the fourth coil network.

8. The heat pump system of claim 7, wherein the refrigerant distributor comprises a hollow interior cavity configured to pool refrigerant from the expansion valve before the refrigerant exits the four distribution conduits.

9. A retrofit heat pump for a water heater comprising:

a housing attachable to the water heater;

a plurality of evaporators disposed within the housing;

a compressor in fluid communication with the plurality of evaporators;

a plurality of condenser circuits disposed proximate a tank of the water heater, the plurality of condenser circuits comprising a first condenser circuit and a second condenser circuit, the first condenser circuit and the second condenser circuit being configured to (a) operate simultaneously and (b) receive refrigerant from the compressor; and an expansion valve comprising a first end in fluid communication with the plurality of condenser circuits and a second end in fluid communication with the plurality of evaporators.

10. The retrofit heat pump of claim 9, wherein the plurality of condenser circuits is disposed within the tank.

11. The retrofit heat pump of claim 9, wherein the plurality of condenser circuits is disposed on an outer surface of the tank and is coiled around the tank.

12. The retrofit heat pump of claim 9, wherein the retrofit heat pump operates at 120V and does not comprise a heating element.

13. The retrofit heat pump of claim 9, wherein:

the plurality of evaporators comprises a first evaporator and a second evaporator;

the first evaporator comprises a first coil network and a second coil network;

the second evaporator comprises a third coil network and a fourth coil network; and the retrofit heat pump further comprises a refrigerant distributor disposed between the expansion valve and the first and second evaporators, the refrigerant distributor comprising a first end in fluid communication with the expansion valve and a second end comprising four distribution conduits, each distribution conduit of the four distribution conduits in fluid communication with one of the first coil network, the second coil network, the third coil network, or the fourth coil network.

14. The retrofit heat pump of claim 9, further comprising a fan disposed within the housing and between a first evaporator and a second evaporator of the plurality of evaporators.

15. The retrofit heat pump of claim 14, wherein the fan is configured to exhaust air from around the plurality of evaporators and to a ventilation conduit associated with either an air conditioning system or a gas exhaust vent.

16. A hybrid water heater system comprising:

a water heater comprising a tank; and a heat pump system attachable to the water heater and comprising:

an evaporator subsystem comprising a first evaporator and a second evaporator;

a compressor in fluid communication with the evaporator subsystem; and a condenser subsystem comprising a first condenser circuit and a second condenser circuit, the first condenser circuit and second condenser circuit being positioned proximate the tank, the first condenser circuit and the second condenser circuit being configured to (a) operate simultaneously and (b) receive refrigerant from the compressor.

17. The hybrid water heater system of claim 16, wherein:

the first condenser circuit and the second condenser circuit are disposed on an outer surface of, and are coiled around, the tank; and the hybrid water heater system further comprises an insulative housing enclosing the first condenser circuit and the second condenser circuit.

18. The hybrid water heater system of claim 16, wherein:

the water heater and the heat pump system are configured to be powered by different power supplies; and the heat pump system comprises an electrical connection configured to connect to and receive power from a 120V power outlet.

19. The hybrid water heater system of claim 16, wherein:

the water heater is a gas water heater comprising an exhaust vent; and the heat pump system comprises a fan positioned between the first evaporator and the second evaporator and coaxial with the exhaust vent.

20. The hybrid water heater system of claim 16, wherein:

the first evaporator comprises a first coil network and a second coil network;

the second evaporator comprises a third coil network and a fourth coil network; and the heat pump system further comprises:

an expansion valve; and a refrigerant distributor comprising a first end in fluid communication with the expansion valve and a second end comprising four outlets, each outlet of the four outlets in fluid communication with one of the first coil network, the second coil network, the third coil network, or the fourth coil network.

* * * * *